US012403348B2

(12) United States Patent
Sekanina et al.

(10) Patent No.: US 12,403,348 B2
(45) Date of Patent: Sep. 2, 2025

(54) MOTORIZED STRENGTH TRAINING MACHINE

(71) Applicant: ePower Motors ApS, Hørsholm (DK)

(72) Inventors: Anders Pedersen Sekanina, Hørsholm (DK); Flemming Bruhn, Hørsholm (DK); Niels Torp Madsen, Copenhagen NV (DK)

(73) Assignee: ePower Motors ApS, Horsholm (DK)

( * ) Notice: Subject to any disclaimer, the term of this patent is extended or adjusted under 35 U.S.C. 154(b) by 114 days.

(21) Appl. No.: 18/560,237

(22) PCT Filed: May 12, 2022

(86) PCT No.: PCT/EP2022/062884
§ 371 (c)(1),
(2) Date: Nov. 10, 2023

(87) PCT Pub. No.: WO2022/238525
PCT Pub. Date: Nov. 17, 2022

(65) Prior Publication Data

US 2024/0226637 A1 Jul. 11, 2024

(30) Foreign Application Priority Data

May 13, 2021 (DK) ..... PA202170244

(51) Int. Cl.
*A63B 21/005* (2006.01)
*A63B 21/00* (2006.01)
(Continued)

(52) U.S. Cl.
CPC ..... *A63B 21/0058* (2013.01); *A63B 21/4047* (2015.10); *A63B 2071/0072* (2013.01);
(Continued)

(58) Field of Classification Search
CPC ..... A63B 21/002; A63B 21/0058; A63B 21/0059; A63B 21/4047; A63B 71/0054;
(Continued)

(56) References Cited

U.S. PATENT DOCUMENTS 4,601,468 A * 7/1986 Bond ..... A63B 24/00 482/901
4,628,910 A * 12/1986 Krukowski ..... A63B 21/0058 482/901

(Continued)

FOREIGN PATENT DOCUMENTS

| | | | |
|---|---|---|---|
| CN | 110237501 | A | 9/2019 |
| CN | 110393894 | A | 11/2019 |
| CN | 110393895 | A | 11/2019 |
| EP | 0857496 | A2 | 8/1998 |

OTHER PUBLICATIONS

International Search Report for International Application No. PCT/EP2022/062884, Sep. 19, 2022, 3 pages.

*Primary Examiner* — Joshua Lee
(74) *Attorney, Agent, or Firm* — Bookoff McAndrews, PLLC

(57) ABSTRACT

Motorized strength training machine comprising an electric motor unit, an axle and a user force input element, said electric motor unit comprising an electric motor, said electric motor being connected to said axle, such that rotation of the electric motor drives said axle and rotation of the axle drives the electric motor, and said user force input element being connected to said axle such that rotation of said axle displaces the user force input element and displacement of said user force input element rotates the axle, said machine further comprising a mechanical range limiting mechanism comprising displaceable first and second rotation limiting stop elements which can be locked in specific angular locations around the axle to mechanically limit the range of
(Continued)

rotational motion of the axle. The mechanical range limiting mechanism comprises a motorized displacement mechanism which is arranged to displace the first and second rotation limiting end stops angularly around the axle based on inputs from a controller. In this way, a safer and easier to adjust strength training machine is provided.

10 Claims, 7 Drawing Sheets

(51) Int. Cl.
*A63B 71/00* (2006.01)
*A63B 71/06* (2006.01)

(52) U.S. Cl.
CPC ..... *A63B 2071/0694* (2013.01); *A63B 2220/16* (2013.01); *A63B 2225/09* (2013.01); *A63B 2225/74* (2020.08)

(58) Field of Classification Search
CPC ..... A63B 71/0622; A63B 2071/0072; A63B 2071/0081; A63B 2071/0694; A63B 2208/0233; A63B 2220/16; A63B 2220/51; A63B 2225/09; A63B 2225/096; A63B 2225/74
See application file for complete search history.

(56) References Cited

U.S. PATENT DOCUMENTS

| | | | | | |
|---|---|---|---|---|---|
| 4,691,694 | A | * | 9/1987 | Boyd | A63B 21/0058 482/901 |
| 4,763,897 | A | | 8/1988 | Yakata | |
| 4,765,315 | A | | 8/1988 | Krukowski | |
| 4,889,108 | A | * | 12/1989 | Bond | A63B 24/00 482/901 |
| 4,905,676 | A | * | 3/1990 | Bond | G16H 40/40 482/901 |
| 4,934,694 | A | | 6/1990 | McIntosh | |
| 4,982,955 | A | | 1/1991 | Heasley | |
| 5,209,223 | A | * | 5/1993 | McGorry | A63B 23/00 482/133 |
| 5,244,441 | A | * | 9/1993 | Dempster | A63B 23/00 482/901 |
| 5,403,251 | A | * | 4/1995 | Belsito | G16H 20/30 345/173 |
| 5,597,373 | A | | 1/1997 | Bond et al. | |
| 5,722,921 | A | | 3/1998 | Simonson | |
| 5,722,937 | A | * | 3/1998 | Smith | A63B 21/0058 601/24 |
| 5,788,607 | A | * | 8/1998 | Baker | A61H 1/0285 482/4 |
| 6,146,341 | A | | 11/2000 | Sato et al. | |
| 7,083,554 | B1 | | 8/2006 | Lo Presti | |
| 10,039,682 | B2 | * | 8/2018 | Einav | G16H 20/30 |

* cited by examiner

MOTORIZED STRENGTH TRAINING MACHINE

CROSS-REFERENCE TO RELATED APPLICATION(S)

This is a National Stage Application under 35 U.S.C. § 371 of International Application No. PCT/EP2022/062884, filed May 12, 2022, which claims priority to Denmark Patent Application No. PA202170244, filed on May 13, 2021.

The current invention relates to a motorized strength training machine comprising an electric motor unit, an axle and a user force input element, the electric motor unit comprising an electric motor, the electric motor being connected to the axle such that rotation of the electric motor rotates the axle and rotation of the axle rotates the electric motor, and said user force input element being connected to the axle such that rotation of the axle displaces the user force input element and displacement of the user force input element rotates the axle, the machine further comprising a mechanical range limiting mechanism comprising displaceable first and second rotation limiting stop elements which can be mechanically locked at different angular locations around the axle to mechanically limit the range of rotational motion of the axle.

DESCRIPTION OF RELATED ART

Strength training machines are well known in the art. With such machines, the user typically rotates a lever or linearly displaces a user force input element, for example a bar or a pedal. Typically, the user force input element is connected to a weight stack via a pulley and cable system. As the user displaces the user force input element, the selected weights in the weight stack are lifted.

It should be noted that in the current specification the term "user force input element" should be understood as an element which the user directly displaces against a load provided by the machine. In many cases, the user force input element will be an element which is held by the user via their hands or pushed/pulled by the user's feet or legs. Also according to this specification, it is specified that the user force input element is "displaced" by the user. The term "displaced" should be understood as being a form of linear or rotational or combination motion of the user force input element.

While many standard strength training machines use a weight stack to provide the load to the user, there are other strength training machines described in the prior art which use electrical devices, for example an electric motor, to provide a resistance against motion. These devices can be programmed to provide a very specific load path. This is different from weight stack based machines, which do not provide very many options for providing a custom load path.

Electric motor powered machines are often used in physiotherapy applications as they provide for more options of control. In one mode the motion of the machine can be controlled by a controller to guide the motion of a user's limb or body. This is typically called an Isokinetic mode of use. In another mode, typically called Isotonic mode, the training machine could be arranged to simulate the effect of a weight stack and the user can apply force to the input device to train the muscles. Since the actuator is controllable, it is possible to program the force to be dependent on where in the path the user force input element is. For example, the force could be increased in positions where the user has good leverage and reduced towards the end of the user's range of motion In another mode (Isometric), the training machine could be arranged to block the motion of the user force input element in different positions, where after the user can apply force to the user force input element and the force can be measured to determine the strength of the user in different positions.

Common for many strength training machines is that they are used in fitness gyms and are designed for healthy people. It is therefore typically up to the user to control the machine properly and ensure that the motion of the machine stays within a suitable range of positions for the user. However, for machines which are used in medical applications, for example in physiotherapy, it is often desired to provide machines with mechanical range limiters, so that the range of possible motion of the machine is defined and the user does not exceed predefined motion limits. Likewise, in machines where the user force input element can be driven by an electric motor, it is also desired to protect the user via a mechanical range limiter in case that the motor or controller experience an error. In certain cases for medical applications, standards are provided which state that the machines must have such mechanical range limiters before they are allowed to be classified as medical equipment.

In general, unless otherwise noted in this application, the training machines of the current invention relate to this second type of training machine and are therefore called "motorized training machines", to differentiate them from the more common type of fitness training machines based on weight stacks. While the current specification discloses electric motor based training machines, within the scope of the invention, other forms of motors could also be used.

U.S. Pat. No. 4,763,897 describes a fitness machine with a weight stack with an angular input member which has a start and stop range limiting device. The range limiting device comprises two pins which are inserted into suitable holes by the user. This can however be complicated for some users and there is a risk that the pins are not set into the correct holes or that the pins fall out of the holes by accident.

U.S. Pat. Nos. 5,722,921 and 4,982,955 disclose other mechanisms based on pins for limiting the range of motion of fitness machines. U.S. Pat. No. 4,765,315 discloses an early attempt to make a motorized training unit, but the motion is again limited with manually adjustable pins.

Prior art range limiting mechanisms can be difficult to operate, be confusing for the user and be difficult for operating personal to check. Likewise, when the mechanical range limiting mechanism is manually operated, there is a risk that the user sets it wrong or completely forgets to set it at all.

SUMMARY OF THE INVENTION

A first aspect of the current invention is therefore to provide a motorized strength training machine which has a range limiting mechanism which is safer and easier to adjust than prior art machines.

These aspects are provided at least in part by a training machine as mentioned in the introductory paragraph and further defined in claim 1. In this way, a strength training machine is provided which is safer and easier to use for the user and a potential trainer.

In one embodiment, the electric motor unit comprises a gearbox connected between the electric motor and the axle.

In one embodiment, the displacement mechanism comprises an electric motor to drive the displacement mechanism, said electric motor being controlled by the controller.

In one embodiment, the displacement mechanism comprises a ring arranged rotationally around the axle, said ring being provided with an engagement mechanism to selectively engage one of the first or second range limiting end stops with the ring so that rotation of the ring displaces the first or second range limiting end stop engaged with the ring or disengage both range limiting end stops so that rotation of the ring does not displace the first or second range limiting end stops. In this way, a single ring and thereby also a single motor can drive both range limiting end stops to provide a simple and low cost mechanism.

In one embodiment, the first and second range limiting end stops each comprise a locking mechanism. When the locking mechanism is activated, the range limiting end stop is locked in position. When the locking mechanism is deactivated, the range limiting end stop is free to be displaced around the axle. In one embodiment, the engagement mechanism of the ring is arranged to deactivate the locking mechanism of the range limiting end stop when the engagement mechanism engages the ring with the range 10 limiting end stop and activate the locking mechanism of the range limiting end stop when the engagement mechanism disengages the ring from the range limiting end stop.

In one embodiment, the engagement mechanism comprises a displaceable sliding element on each rotation limiting end stop and a protrusion fixed to each slideable element is arranged in a slot on the ring, said slot having a main circular slot portion and an offset circular slot portion which is offset from the main circular slot portion and connected to the main circular slot with a ramped portion at either side of the offset circular slot portion. In one embodiment, the ramped portion has a ramp with an angle to the circular slot portion which is less than 75 degrees. In one embodiment, the ramped portion as a ramp with an angle to the circular slot portion which is greater than 15 degrees. In one embodiment, the length of the offset slot portion is less than 10%, less than 7.5% or less than 5% of the length of the main circular slot portion. In one embodiment, the slideable element engages with a slot in a stationary housing in an extended position of the slideable element to lock the position of the end stop and the slideable element disengages with the slot in the stationary housing in a retracted position of the slideable element to unlock the position of the end stop.

In one embodiment, the mechanical range limiting mechanism comprises at least two indicator elements, one indicator element associated with each rotation limiting end stop to clearly indicate to a user the position of the rotation limiting end stops. In one embodiment, the motorized strength training machine comprises a display unit which displays to the user prior to starting the exercise, the required status and position of the at least two indicator elements. In this way, the user/trainer can easily check if the machine has set the end stops to the correct position.

In one embodiment, the mechanical range limiting mechanism comprises a circular array of light elements arranged around the axle, the light elements indicating the position of the first and second range limiting end stops by lighting up at least two of the light elements.

In one embodiment, the first and second range limiting end stops provide a light connection between a stationary light source arranged behind the first and second range limiting end stops and a light element of the circular array of light elements to selectively light up the light elements to which the first and second range limiting ends stops are connected.

In one embodiment, the motorized strength training machine further comprises a second user force input element, a first force sensor being mounted between the user input element and the motor and a second force sensor being mounted between the second input element and the motor, said second user force input element being connected to the axle such that rotation of the axle causes displacement of the second user force input element and displacement of the second user force input element causes rotation of the axle, said machine having a display with an indicator which indicates to the user the difference between the readings of the two force sensors.

In one embodiment, the force sensor is a strain gauge. In one embodiment, the display comprises a first display element and a second display element, the first display element illustrating the force input on the first force input element and the second display element illustrating the force input on the second force input element, the relative difference between the two readings being shown by the difference in the display outputs. In one embodiment, the first force sensor and the second force sensor are mounted on the axle, one on each side of the motor. In one embodiment, the axle is provided with two reduced diameter sections, one on either side of the motor, the force sensors being mounted on the axle on the two reduced diameter sections. In this way, the axle can easily be inserted into the motor unit with the force sensors, for example strain gauges already mounted on the axle. This allows the force sensors to be mounted on the axle already at the factory which is much easier and provides for a stronger and more robust part.

The current invention also provides for a system of motorized strength training machines comprising a first and second motorized strength training machine as described above, where the first and second motorized strength training machines both comprise a housing having a circular cross section taken on a vertical plane and being supported on a base portion, the electric motor unit arranged inside the housing, the first and second motorized strength training machines being arranged such that the axles of the first and second machines are arranged horizontally and are located at a first position relative to the base and a second position relative to the base respectively, wherein the housing and the electric motor unit is the same in the first and the second machine, but the angular positions of the electric motor unit is different in the first and second machine so that the first and second positions of the axles relative to the base in the two machines are different.

The current invention also provides for an arrangement of motorized strength training machines comprising a first motorized strength training machine as described above and a second machine as described above, the first and second machines providing different training types.

A second invention disclosed in the current application is the provision of a system of motorized strength training machines comprising a first and second motorized strength training machine, said first and second motorized strength training machines comprising a housing having a circular cross section taken on a vertical plane and being supported on a base portion and having an electric motor unit arranged inside the housing, the first and second motorized strength training machines being arranged such that axles driven by the electric motor units inside the housings of the first and second machines are arranged horizontally and are located at a first position relative to the base and a second position relative to the base respectively. The system is further characterized in that the housing and the electric motor unit is the same in the first and the second machine, but the angular position of the electric motor unit is different in the first and second machine so that the first and second positions of the axles relative to the base in the two machines are different.

In this way, a system of manufacturing is provided where a large number of different types of machines can be provided based on the same basic base and housing/motor unit. This reduces the number of necessary variants and thereby reduces manufacturing, storage and assembly costs.

In one embodiment, the first machine is a strength training machine for a leg focused exercise and the second machine is a strength training machine for an upper body focused exercise. In one embodiment, the first machine is a leg extension strength training machine and the second machine is a lateral pull strength training machine. In one embodiment, the first machine and the second machine both comprises a range limiting mechanism and in that the range limiting mechanism of the first and second machines is the same.

A third invention disclosed in the current application is the provision of a strength training machine where the strength training machine comprises a first user force input element, a second user force input element, a load providing unit, a first force sensor being mounted between the first user force input element and the load providing unit and a second force sensor being mounted between the second user force input element and the load providing unit, said training machine having a display with an indicator which indicates to the user the difference between the measurements of the two force sensors.

In one embodiment, the force sensors measure the force input by the user. In another embodiment, the force sensors measure the force applied to the user by the user force input elements.

It should be noted that the current specification discloses three separate inventions. While many of the features of the inventions have only been explicitly described in the claims with respect to the first invention, it should be clear to the reader, that the features of the claims could also be combined with the second and third invention, even though they are not explicitly listed herein.

It should also be emphasized that the term "comprises/comprising/comprised of" when used in this specification is taken to specify the presence of stated features, integers, steps or components but does not preclude the presence or addition of one or more other features, integers, steps, components or groups thereof. For example, in the first claim, it is stated that the machine comprises a user force input element. However, this should be interpreted as at least one user force input element and does not disclaim machines having more than one user force input element.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
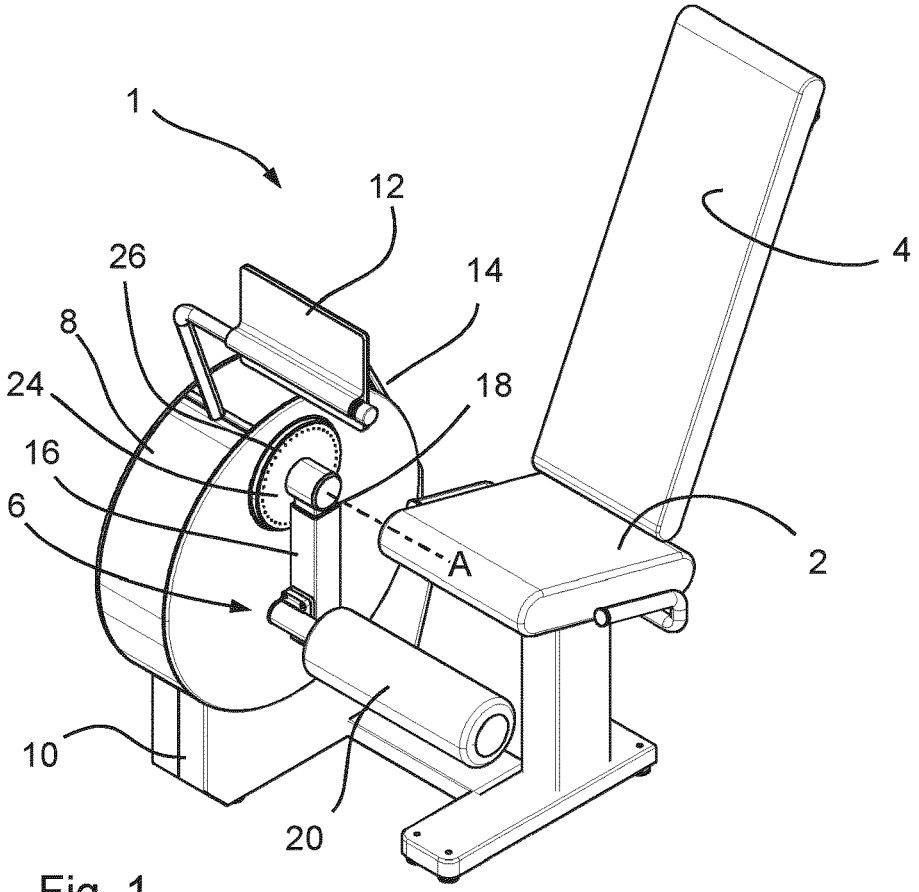
FIG. 1 shows a perspective view of a first embodiment of a motorized strength training machine of the invention in the form of a leg extension machine with an upright back support.

FIGS. 1-4 show different views of a first embodiment 1 of a motorized strength training machine according to the current invention. In this embodiment, the strength training machine is in the form of a leg extension strength training machine. Leg extension strength training machines of the general kind shown in FIGS. 1-4 are well known in the art and the function of such machines will not be described in detail here. However, while the overall function of the machine is known in the art, the details of the implementation are different and the current invention relates to the details of the implementation as defined in the claims.

The machine 1 comprises a seating portion 2, a back support portion 4, a user force input element 6, a housing 8 and a base 10. In this embodiment, a display 12 with a graphical user interface and a mobile phone holder 14 are also provided.

Figure 2:
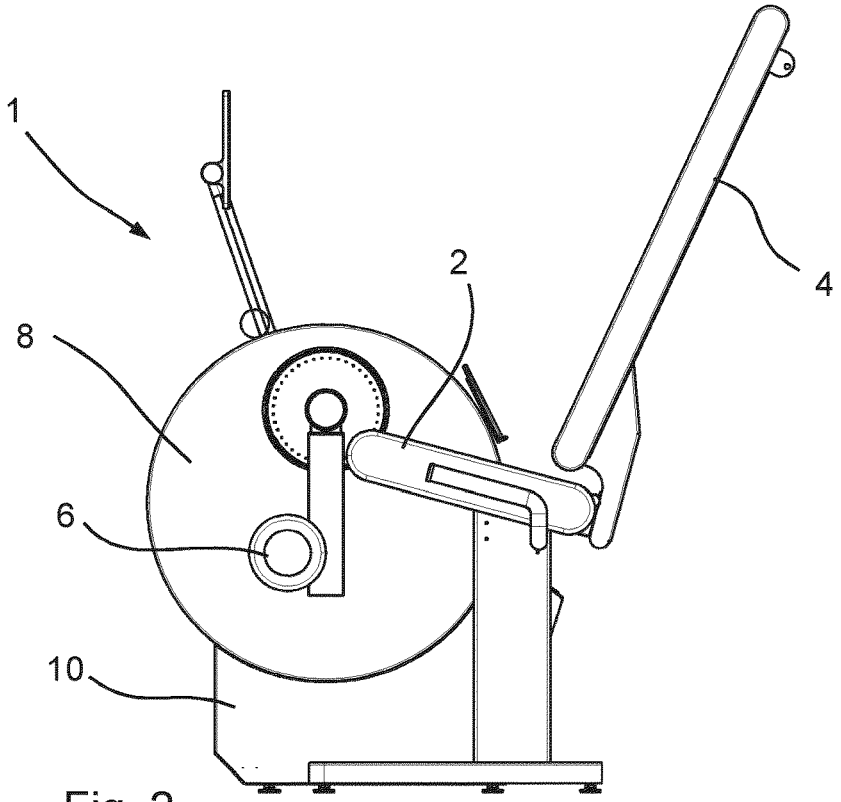
FIG. 2 shows a side view of the machine of FIG. 1.
Figure 3:
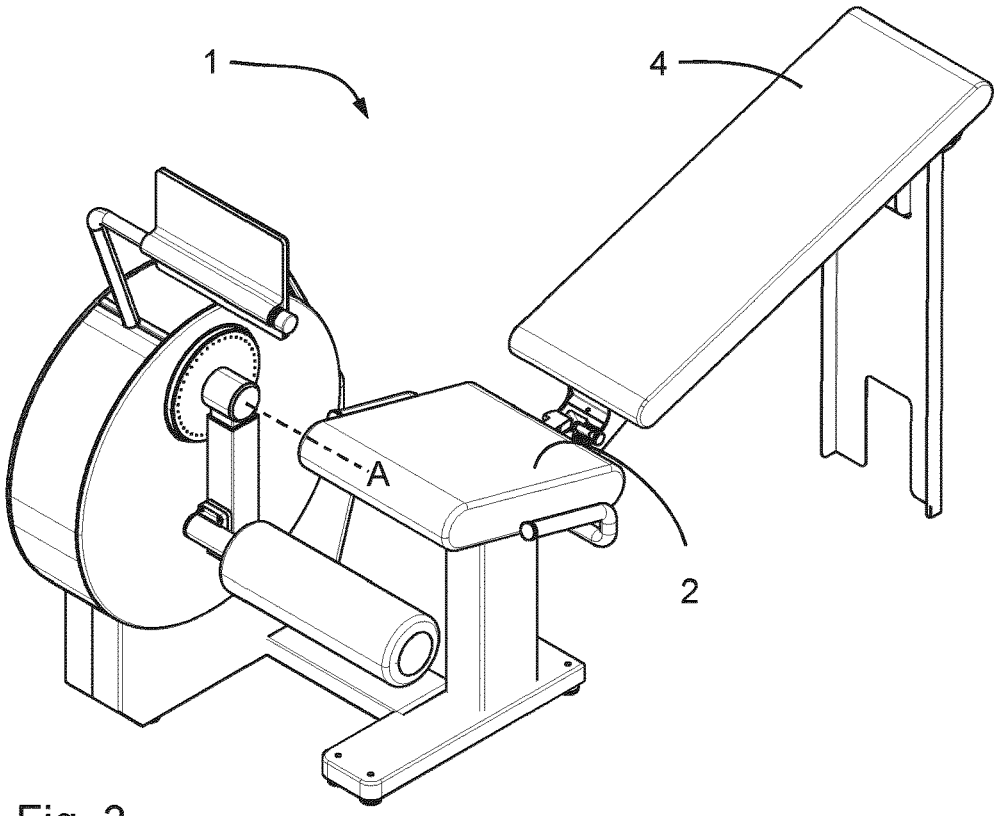
FIG. 3 shows a perspective view of the machine of FIG. 1, but with a lowered back support.
Figure 4:
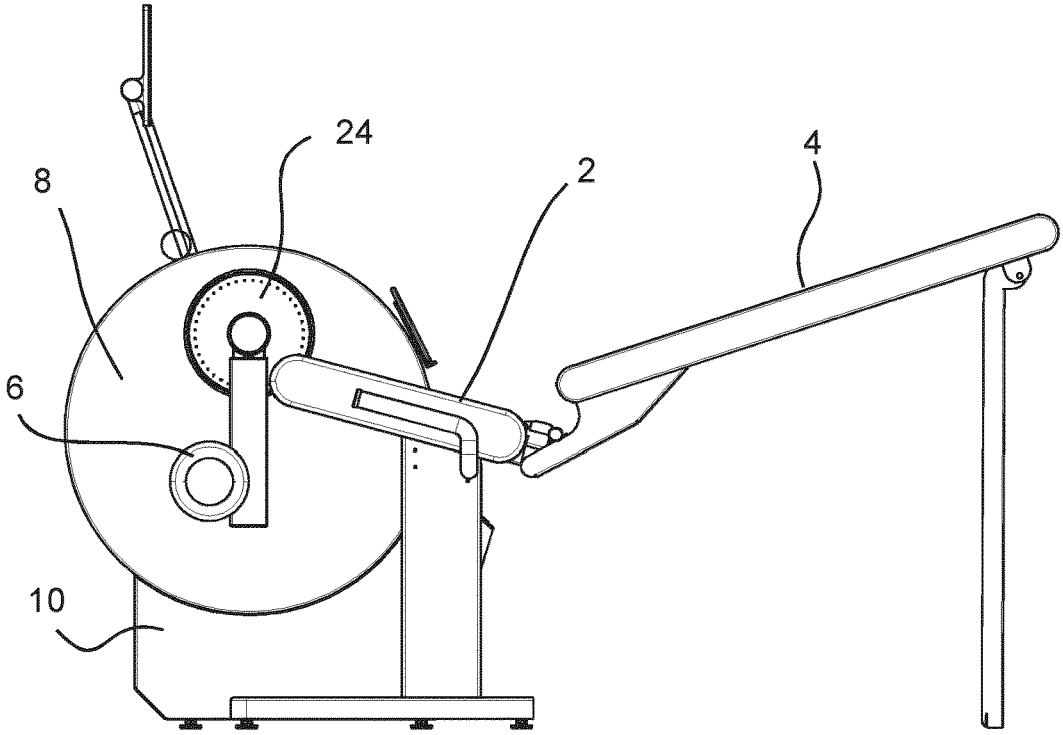
FIG. 4 shows a side view of the machine of FIG. 3.
Figure 5:
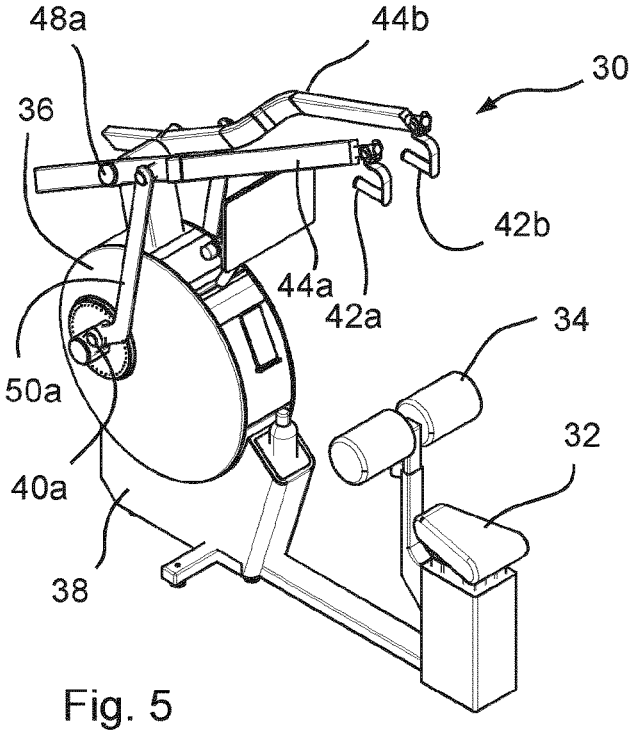
FIGS. 5, 6, 7 and 8 show a left perspective view, a right perspective view, a left side view and a right side view respectively of a second embodiment of a motorized strength training machine according to the invention in the form of a lateral pull machine.
Figure 6:
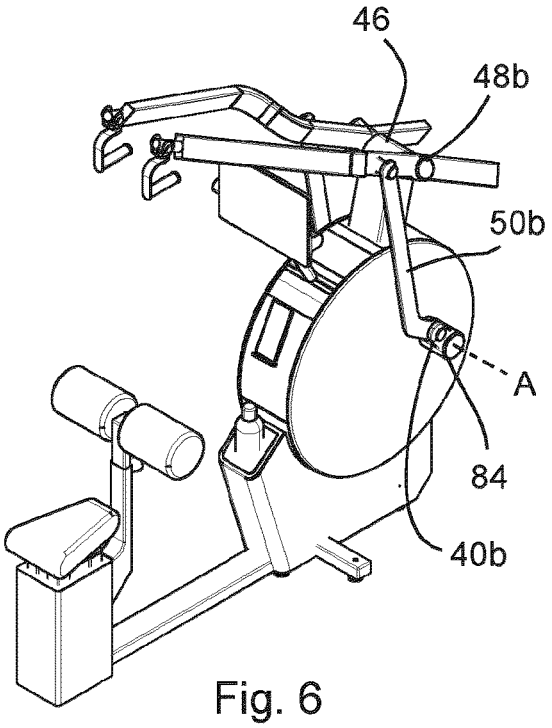
Figure 7:
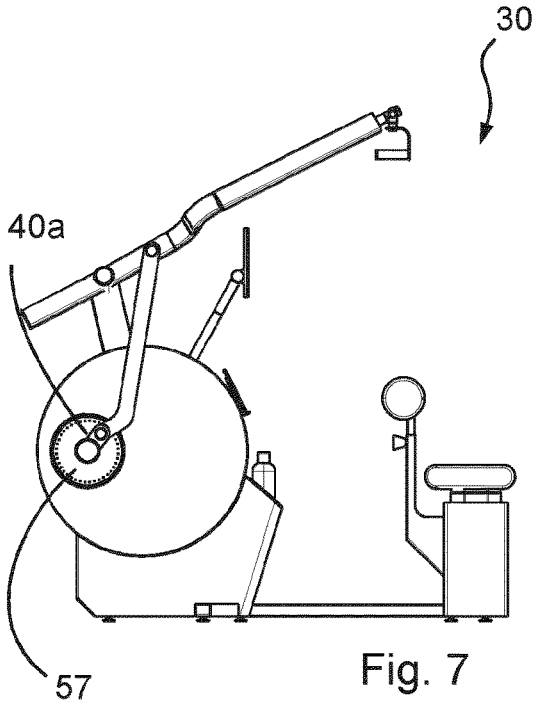
Figure 8:
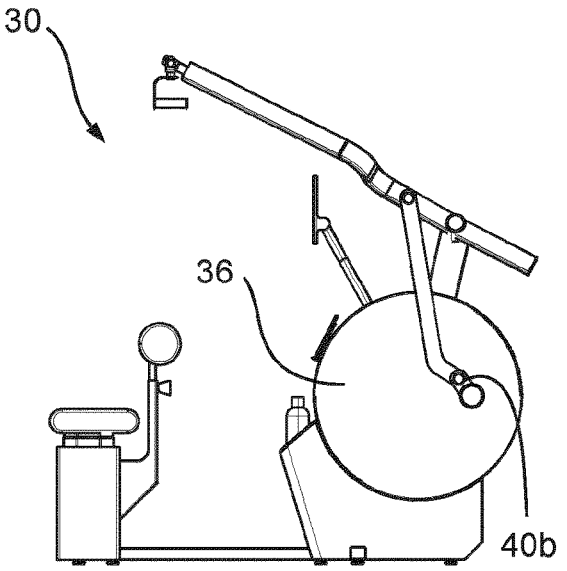
Figure 9:
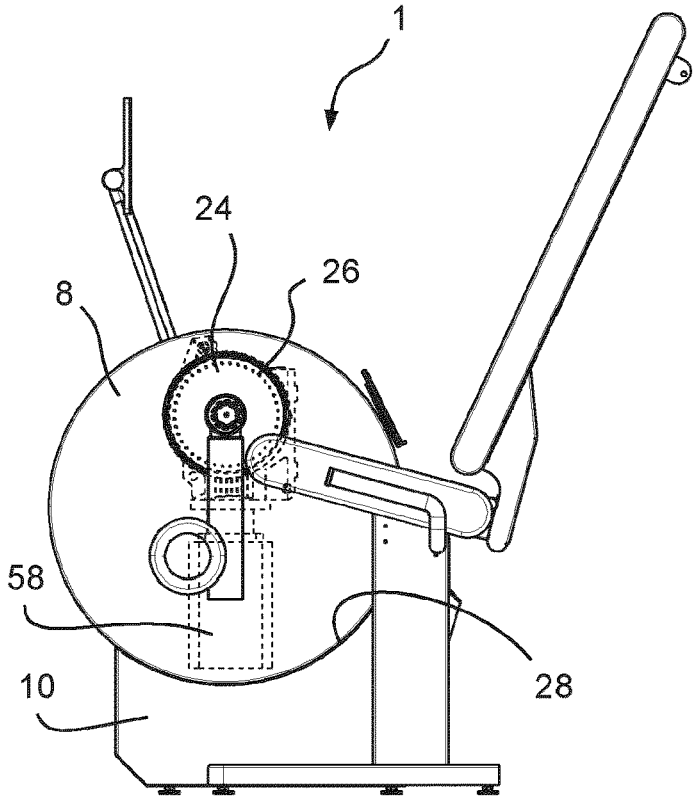
FIG. 9 shows a side view of the machine of FIG. 1 showing the placement of the motor unit arranged inside the housing in dashed lines.
Figure 10:
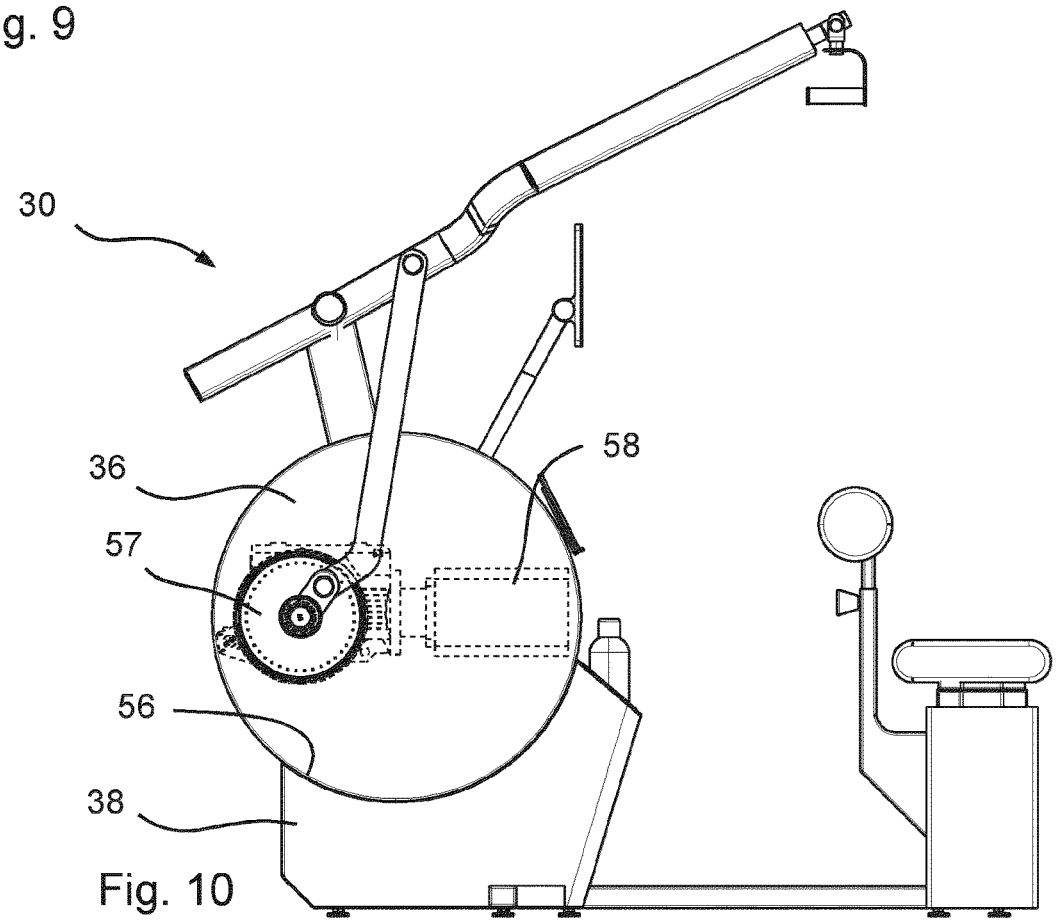
FIG. 10 shows a side view of the machine of FIG. 5, showing the placement of the motor unit arranged inside the housing in dashed lines.
Figure 11:
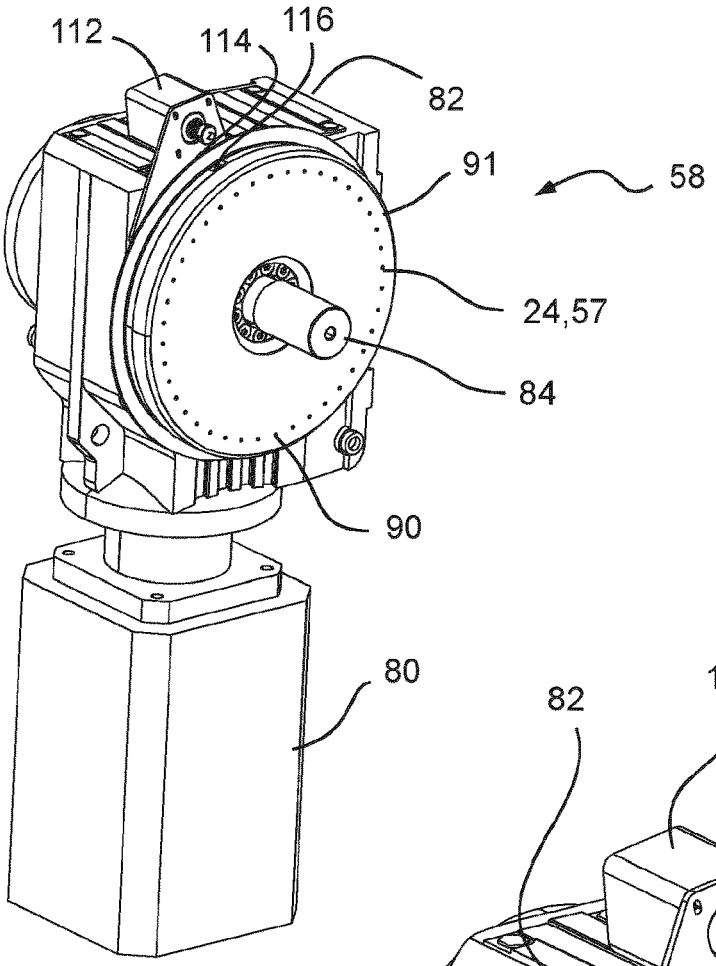
FIG. 11 shows a perspective view of one embodiment of a motor unit of the current invention.
Figure 12:
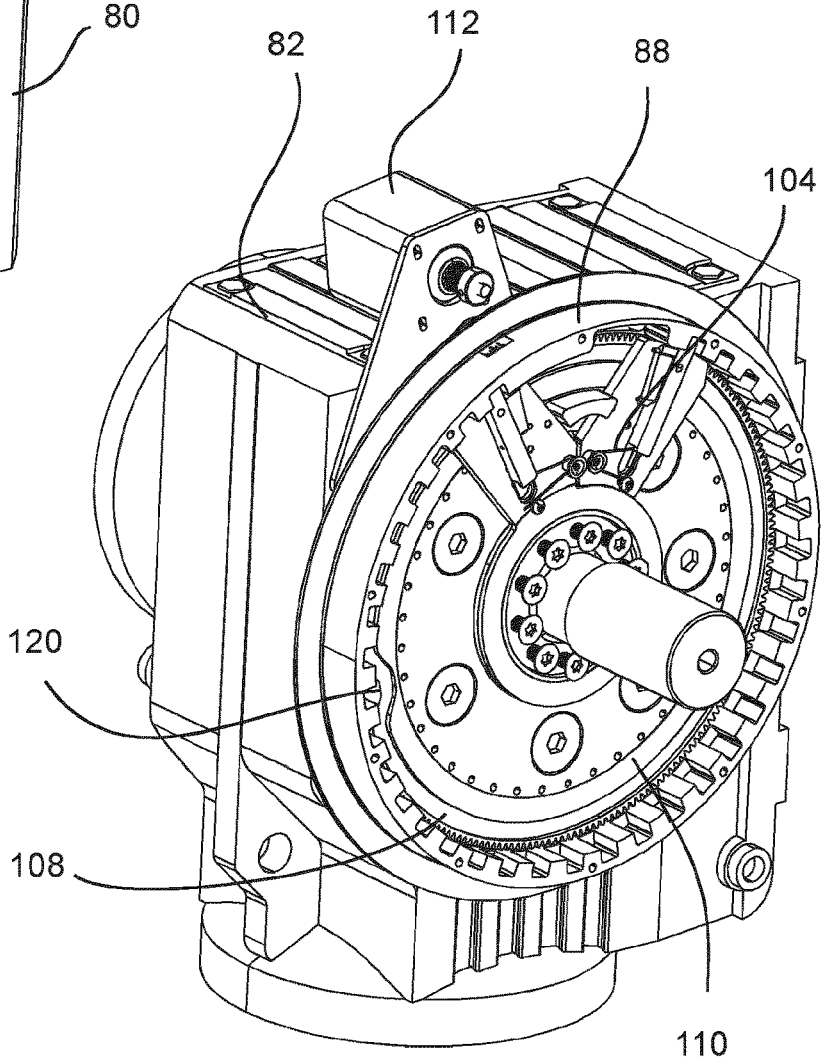
FIG. 12 shows a close-up perspective view of the motor unit of FIG. 11 with some parts removed to show the internal mechanical details of the motor unit.
Figure 13:
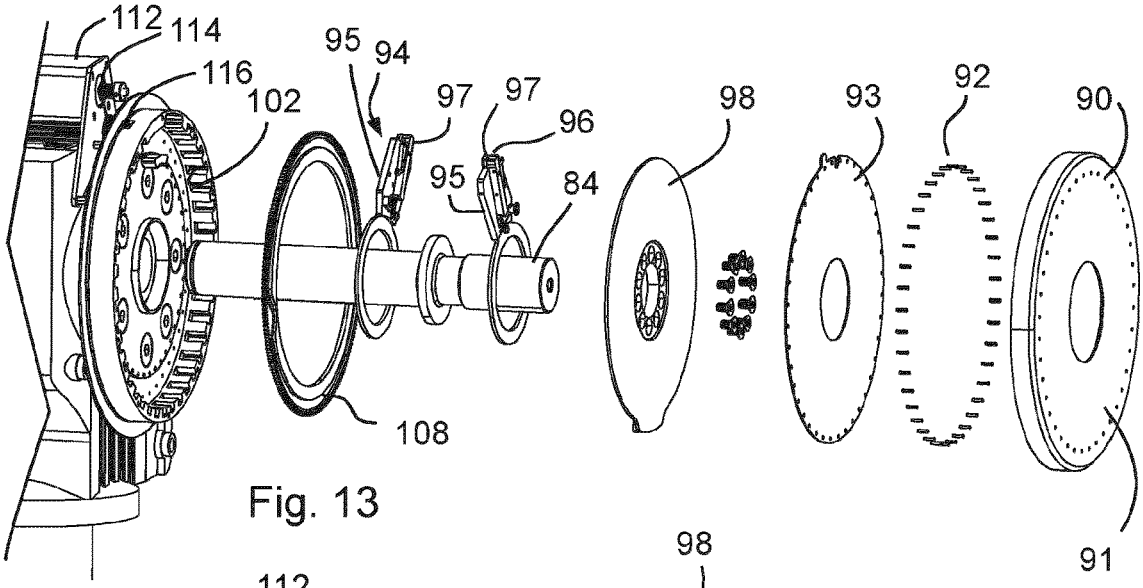
FIGS. 13, 14 and 15 show some different exploded views of the motor unit of FIG. 11.

The back support portion 4 in this machine is provided with a position adjustment mechanism to allow the back support portion to be arranged in an upright position as shown in FIGS. 1 and 2, and a laying down position as shown in FIGS. 3 and 4. In this way, the machine can be used for different types of exercise depending on the position of the back support portion.

The machine of the current invention is of the kind which is driven by an electric motor unit 54 arranged in the housing 8. The details of the electric motor unit 54 are discussed later on in this specification in relation to FIGS. 9-16. As the machine is driven by an electric motor, the training machine can be used in different modes.

A first mode which the machine in the embodiment can be operated in is a controlled motion mode, or "Isokinetic" mode, where the user force input element 6 is controlled to follow a predefined position and velocity path. The user will engage with the user force input element and the machine will move the element and thereby force the user to move in the same manner. In a second mode, the user interface element is moved to different positions and then held firmly in place by the electric motor. This is often called an "isometric" mode. The user can then apply force to the user interface element and the machine measures the force input.

In this way, a user profile can be generated with details of the users strength at different positions. A third mode is a strength training mode, or "isotonic" mode, where the user applies a force to the user force input element and the electric motor resists the motion of the user. The amount of force which the machine exerts can be programmed specifically for the user and the machine can apply different force at different positions.

The overall mechanical construction of the training machine 1 is of the generally well known type and will not be described in great detail here as it is expected that the person skilled in the art of strength training machines will be familiar with the details. The user force input element 6 comprises a lever arm 16 pivotably connected to the housing 8 to rotate about an axis A. The lever arm is connected to an axle 84 (described later on) which drives an electric motor unit 58 arranged in the housing 8. The lever arm 16 is provided with a telescopic adjustment mechanism 18 to allow the length of the lever arm to be adjusted for different sized users. A padded cylinder 20 extends perpendicularly from the end of the lever arm. The user will sit in the machine and arrange their legs behind the padded cylinder. The user will then apply force to the padded cylinder with the front portion of their legs to rotate the lever arm about the axis A.

Of interest in this embodiment, is that housing 8 in which the electric motor unit 58 is arranged is a circular housing which is mounted on the base 10. As will be described in more detail with respect to FIGS. 9 and 10, by providing the training machine with a circular housing, it is easy to provide different types of training machines just by rotating the circular housing and thereby the electric motor unit. In addition to providing a simple manner of building the machines, this also provides for a homogeneous visual impression of different types of machines in the same series as the base and housing will appear very similar, just the point of rotation of the lever arm will be different. It is also to be noted that the machine comprises a mechanical range limiting mechanism 24 which can be programmed to limit the motion of the lever arm to a particular range. This safety mechanism is described in more detailed later on in this specification. A series of lights 26 arranged in a circular array around the mechanical range limiting mechanism visually indicates the position of end stops (described later) arranged inside the housing of the mechanical range limiting mechanism. In this way, the user and/or a trainer can easily check the position/status of the mechanical range limiting mechanism.

FIGS. 5-8 show some different views of a second embodiment 30 of a strength training machine of the current invention. This embodiment shows a lateral pull strength training machine. In some embodiments this can also be called a lat pull down machine. This machine 30 comprises a seat portion 32, a leg hold down portion 34, a housing 36 with an electric motor unit 58 of the same kind as in the first embodiment arranged inside the housing and a base 38. Two lever arms 40*a*, 40*b* are pivotably arranged on either side of the housing and connected to an axle 84 engaged with the electric motor unit 58 arranged in the housing 36. The machine further comprises a first and second handle 42*a*, 42*b*, a first and second pivot bar 44*a*,44*b* connected to the first and second handle respectively, a pivot support assembly 46 with two pivot points 48*a*,48*b* about which the pivot bars pivot and first and second links 50*a*, 50*b* pivotably connected to the first and second pivot bars and first and second lever arms respectively. In this way, as the axle 84 of the motor unit turns, the lever arms will also turn and thereby cause the pivot bars and therefore the handles to also move. Likewise, if the handles are pulled down or displaced upwardly by a user, the pivot bars will also move, thereby causing the links to move and therefore the lever arms will rotate, thereby causing the axle to also rotate and thereby drive the electric motor unit 58.

In this embodiment, as there are two user force input elements, i.e. two handles 42*a*,42*b*, the user can apply different forces to the two different user force input elements. For example, the user might be stronger with their left arm than their right arm. As such, the user will be able to apply more force to the left handle than the right handle. As this can be difficult to judge for the user during motion, the current embodiment, furthermore comprises two strain gauges (not shown) attached to the axle 84 on each side of the electric motor unit. The strain gauges are not shown as they are hidden during normal use. In order to ease assembly and manufacturing, in this embodiment, the axle is provided as a cylindrical shaft of 40 mm in diameter.

A section of the cylindrical shaft on either side of the centre portion will be reduced in diameter, to for example 35 mm. The strain gauges are applied to the shaft at these reduced diameter portions. In this way, the shaft can easily be inserted into the electric motor unit with the strain gauges already mounted on the shaft. The strain gauges then just have to be electrically connected. It should be noted that in this embodiment, the shaft rotates less than 360 degrees. In this way, the wires connected to the strain gauges will not be in danger of wrapping around the shaft during use of the machine.

It will be clear to the reader than the strain gauges could be applied at different locations. This is especially true if the shaft would need to rotate more than 360 degrees. In this case, the strain gauges could be mounted on two of the links of the machine, one on either side of the machine. Furthermore, other forms of user force input sensors could be used instead.

Of particular interest to the current specification is that two different user force input sensors are provided, each one connected to the machine such as to measure the force input applied to each one of two different user force input elements. This information can be displayed to the user during the exercise as described later on in this specification in relation to FIGS. 17*a*-17*e*.

The machine of FIGS. 5-8 also comprises a mechanical range limiting mechanism 57 similar to the one described in respect to FIGS. 1-4.

As in the previous embodiment, the machine of this embodiment also has a circular housing 36 which houses the electric motor unit. As can be seen by comparing FIGS. 9 and 10, it can be seen that the housing is essentially the same in the first and second machines, but the electric motor unit 58 has just be rotated on the base to position the axle at different positions. Positioning the axle at different vertical positions, allows the ergonomic position on the machine for the end user to be optimized. In the lateral pull machine 30, the axle is located in a lower vertical position than the axle in the leg extension machine 1. As can be seen from FIGS. 9 and 10, the electrical motor unit 58 is shown in dashed lines hidden inside the circular housing 8,36. However, as can be seen, the motor unit is essentially the same and the entire housing has just been rotated in the two embodiments. Likewise, it can be seen that the base unit is also essentially the same and has a semi circular support portion 28, 56 on top of which the circular housing is arranged. In this way, the base unit and the housing/electric motor unit is essentially the same for multiple different types of machines. As such, the number of different components which need to be manufactured is much reduced when compared to prior art type machines. This reduces the cost and complexity of the machines significantly. Especially for electric motor driven strength training machines, reducing the cost and complexity of the electric motor unit has a significant impact on the total cost of a series of machines.

FIGS. 11-16 show different views of the electric motor unit 58 and mechanical range limiting mechanism 24, 57. The electric motor unit 58 comprises an electric motor 80, a gear box 82 and an axle 84. In the current embodiment, the axle of the motor (not shown) is arranged at 90 degrees to the axle 84 of the motor unit. The gear box is therefore arranged to translate the motion of the electric motor 90 degrees. While not clear from FIGS. 11-16, the gear box is arranged with a through going opening, such that in certain machines, the axle can be inserted into the gear box such that the axle only extends outside of the housing on one side of the housing, as in the case of the leg extension machine 1 while in other machines, such as the lateral pull machine 30, the axle can be inserted into the gear box such that the axle extends out of both sides of the housing.

A mechanical range limiting mechanism 24, 57, is also provided as an integrated part of the electric motor unit. The mechanical range limiting mechanism comprises a main housing 88 which is bolted to the housing of the gear box, such that the main housing 88 of the range limiting mechanism is stationary with respect to the gear box. A ring of openings 90 is provided on the outer cover portion 91 of the housing. In the current embodiment, a circular array of light guide rods 92 are arranged in cooperation with each opening. The light guide rods are held in position via a support plate 93 which is arranged stationary inside the main housing 88.

Inside the housing, two independently moveable range limiting stop elements 94,96 are provided. The range limiting stop elements are arranged to rotate about the axle to assume fixed angular positions about the axle. The range limiting stop elements are arranged to be rotatable independently of the axle. A disc 98 is also provided inside the housing and is bolted to the axle such that it rotates with the axle. A protrusion 100 is provided on the disc. The protrusion is arranged between the two range limiting stop elements and is arranged such that when the protrusion contacts either one of the range limiting stop elements 94, 96 further motion of the axle will be prevented.

The stop elements are independently displaceable and can lock in position with respect to the main housing 88 of the safety mechanism. Each stop element comprises a main body portion 95 and a slideable locking element 97 slideably arranged with respect to the main body portion. The slideable locking element is arranged to slide along an axis which is essentially perpendicular to the axle 84. When the slideable locking element is retracted towards the axle, the main body portion of the stop element is able to be rotated around the axle. When the slideable locking element is extended, it engages with a groove 101 of an inner surface 102 of the main housing 88. The inner surface of the main housing 88 is provided with a circular array of grooves to provide a form of circular toothed portion. In this way, the range limiting stop elements can engage with different grooves on the inner surface of the housing to limit the motion of the axle depending on the desires of the user.

The slideable locking elements 97 are pushed into an extended position via a biasing spring 104. The edges of the outer portion 103 of the slideable locking element are filleted so that when the outer portion of the locking element engages with the toothed outer portion, in a retracted position, the slideable locking element can snap over the grooves of the toothed portion. This provides a tactile and audible indication of when the slideable locking element engages with a groove in the toothed portion.

Figure 14:
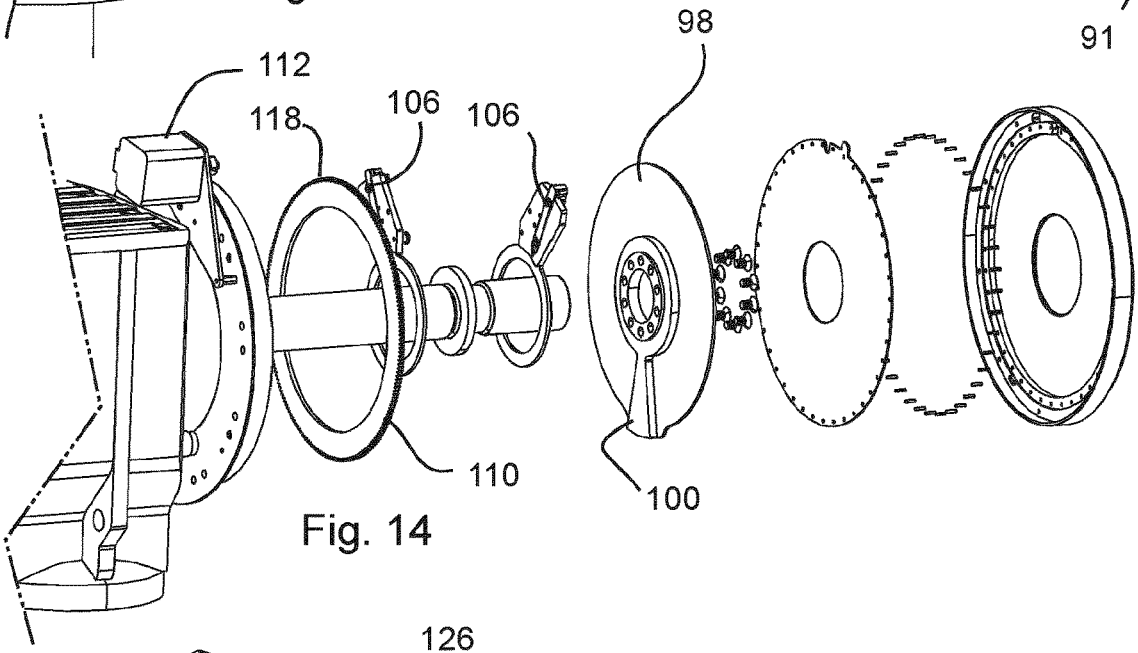
Figure 15:
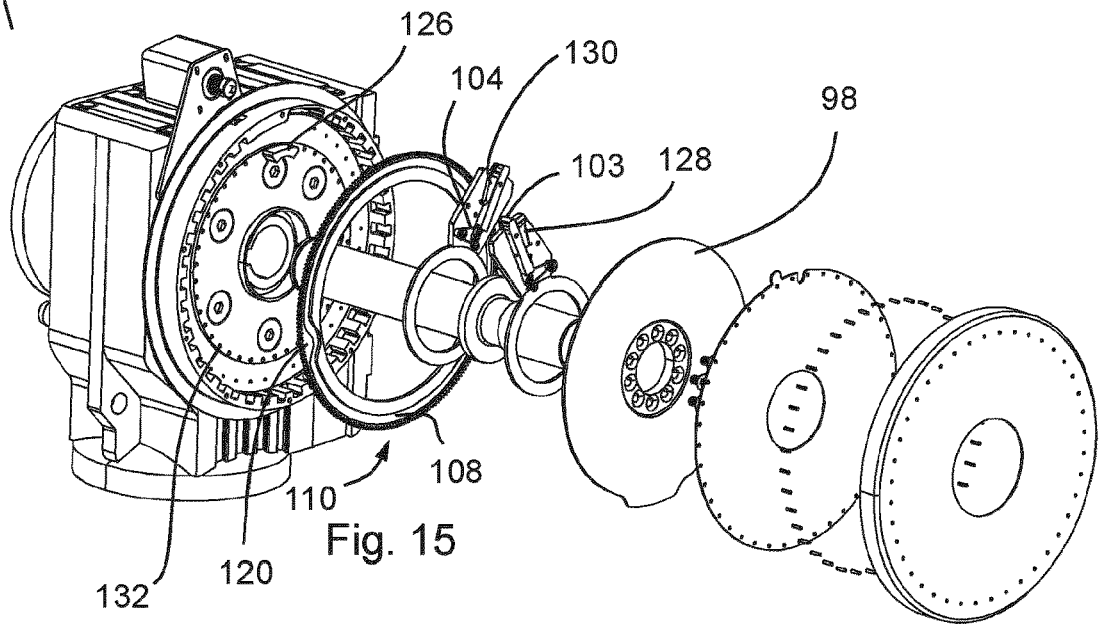
Figure 16:
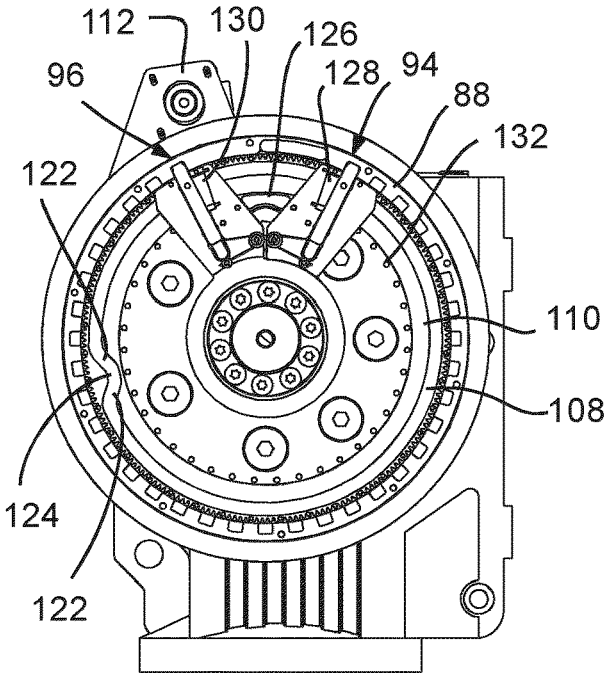
FIG. 16 shows a front view of the motor unit of FIG. 11 with some parts removed to show the internal mechanical details of the motor unit.

The gear box facing portion of the slideable locking element 97 comprises a rounded protrusion 106, best seen in FIG. 14. The rounded protrusion is arranged in a slot 108 of a rotating ring shaped disc 110. The rotating ring shaped disc is driven by a motor 112 via a belt (not shown) driving a pulley 114 and a toothed sprocket 116. The toothed sprocket engages with a toothed outer portion 118 of the ring 110.

The slot 108 in the ring shaped disc 110 is essentially circular, but has a portion 120 which comprises two ramped sections 122 and an intermediate portion 124 arranged between the two ramped sections. When the ring rotates, the round protrusions 106 of the slideable locking elements will slide in the slot without moving the slideable locking elements. However, when a round protrusion of a slideable locking element comes into contact with one of the the ramped portions, the ramped portion will cause the rounded protrusion to follow the ramped portion and this will cause the slideable locking element to retract towards the axle. Once the rounded protrusion reaches the intermediate portion 124, the slideable locking element will be almost fully retracted. Further rotation of the ring shaped disc will now cause the range limiting stop element to rotate in the same direction as the ring shaped disc. When the stop element is in a desired position, the ring shaped disc will be rotated in the opposite direction and the rounded protrusion will slide down the ramp and push the slideable locking element into engagement with the toothed outer portion of the housing.

It should be noted that in the embodiment shown in the figures, the single ring shaped disc can control both stop elements via a single actuator. It should also be noted that in general, the ring shaped disc displaces the range limiting stop element in one direction only at one time. When it is desired to move the stop element in the opposite direction, it is necessary to displace the stop element all the way to one end of its motion. When the stop element is at its end position, the stop element to be blocked from further motion. This will cause the sloped portion 122 of the slot to push past the rounded pin. The sloped portion of the slot will then be on the other side of the rounded protrusion. When the ring shaped disc changes direction, the ring shaped disc can then push the stop element back in the opposite direction.

A typical progression will be that the stop elements will start in the position shown in FIGS. 11-16. The sloped portion of the slot will then be rotated counter clockwise until the sloped portion engages the rounded protrusion 106 of the slideable locking element of the first stop element 94. Since the first stop element is in contact with the stop portion 126, it is not possible for the stop element to rotate further in a counter clockwise direction. Hence, further rotation of the disc 110 will cause the disc to displace the slideable locking element in towards the axle and the extend it again, leaving the sloped portion 120 of the slot 108 behind the stop portion 126 and between the two stop elements 94,96. The ring shaped disc will then rotate clockwise to push the first stop element 94 clockwise to the desired position. Then the disc 110 will rotate counter clockwise, to push the second stop element to the desired position. The disc will then rotate back to a centered position with the sloped portion behind the stop portion 126. The user can then perform the activity.

When the user is finished with the activity, the system can rotate the ring shaped disc 110 counter clockwise and push the second stop element all the way until it stops against the first stop element. Then the sloped portion will pass the rounded protrusion of the second stop element. The ring shaped disc can then be rotated clockwise to push the second stop element back to its initial position. Further clockwise motion of the disc will push the disc past the second stop element. The disc can then proceed to rotate in a clockwise direction until it engages the first stop element. The first stop element can then be rotated all the way until it stops against the second stop element. The disc will then push past the first stop element. The disc can then be rotated counter clockwise, to push the first stop element back to the start position. Further counter clockwise motion will push the disc past the first stop element and the sloped portion 120 will then again be located between the first and second stop elements, ready to push either the first or second stop element to its desired position.

It should be noted that this range limiting mechanism, cannot cause the axle and the associated user force input element to rotate. Hence, if a specific start position is desired for the machine, then the electric motor unit of the machine will first rotate the axle to its desired start position, and then the mechanical range limiting stop elements 94,96 will be rotated into their desired positions.

It should be noted that in general use, the motor itself will control the motion of the axle and the resulting range of motion is therefore controlled by the motor itself. However, for the sake of safety, the range limiting stop elements are provided in case something goes wrong with the motor or the motor controller. In such a case the stop elements will prevent the motor from rotating the user force input element too far. Such a mechanical range limiting safety mechanism is however not required in all situations. In lower cost fitness machines where it is expected that healthy individuals are using the machine, a mechanical range limiting mechanism is not required. However, for strength training machines used in medical situations, for example with patients in a physiotherapy situation, a mechanical range limiting mechanism is required to uphold safety standards for such machines.

The range limiting stop elements also comprise a light guide element 128, 130 associated with each stop element. The light guide elements 128, 130 rotate with the stop element and connect a light source (not shown) arranged behind the housing 88 to the openings 90 in the front cover 91. The light source shines light through openings 132 in the rear surface of the main housing 88. The light guide element 128, 130 connects the light from the openings 132 to the light rods 92 in the front cover 91. In this way, two points will light up on the outer housing, depending on the position of the range limiting stop elements 94,96. By reviewing which lights are lit up on the front surface of the front cover, the trainer/user is able to quickly review if the safety settings are correctly set before starting the exercise. It will also be possible to display on the display of the machine which lights should be lit up and then the user/trainer can easily check that everything is correct. The light source arranged behind the housing 88 could take many forms. In one embodiment, it is in the form of a circular ring of LED lights, a separate LED light associated with each opening in the housing. In another embodiment, a light guide ring could be arranged behind the openings.

As was mentioned previously in respect to the machine shown in FIGS. 5-8, certain machines will have two separate user force input means. According to one invention of this specification, it is proposed to add a force measurement sensor, for example a strain gauge, to each of the two user force input means. By monitoring the two force measurement sensors, it will be possible to determine if the user is applying equal force to both input means or is applying an unbalanced force. In the embodiment shown in the figures, it is suggested that a strain gauge is applied on the axle on either side of the gear box and inside the connection of the lever arms. In this way, the user force input will be applied on the two ends of the axle, and the gearbox is mounted in the centre of the axle. The force input sensors will then be placed in between the location where the user force is applied to the axle and the location where the motorized training machine will apply its counter force. This true for both sides of the machine.

In order to provide feedback to the user in real-time, it is suggested to provide a display which displays the difference between the readings of the two different force sensors in a graphical manner. FIGS. 17*a*-17*e* describe some different options for displays to display the information from the two force measuring sensors described above with respect to FIGS. 5-8.

In the embodiment of 17*a*, a teeter totter like graphical display 150 is provided. When the applied force is equal, the beam 152 of the teeter totter will be essentially horizontal as shown in the top view of FIG. 17*a*. When more force is applied to the left input device, the beam 152 of the teeter totter will tilt towards the left as shown in the middle view of FIG. 17*a* and when more force is applied to the right input device, then the beam 152 of the teeter totter will tilt towards the right as shown in the bottom view of FIG. 17*a*. In effect, the teeter totter element will show the difference between the two measurements, but will not provide any information on magnitude of the overall applied force.

Figure 17A:
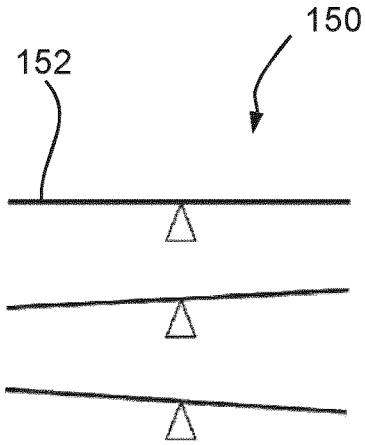
FIGS. 17*a*-17*e* show schematic views of different graphical user interface (GUI) displays.
Figure 17B:
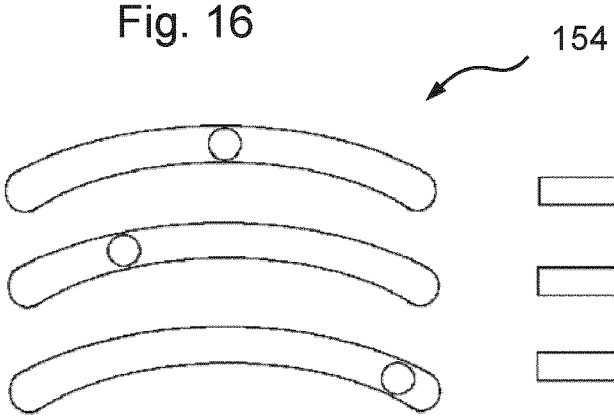
Figure 17C:
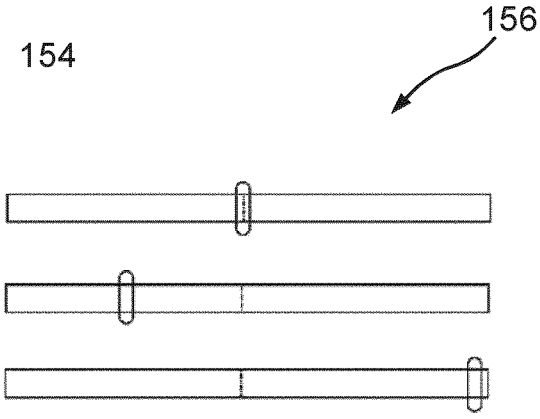
Figure 17D:
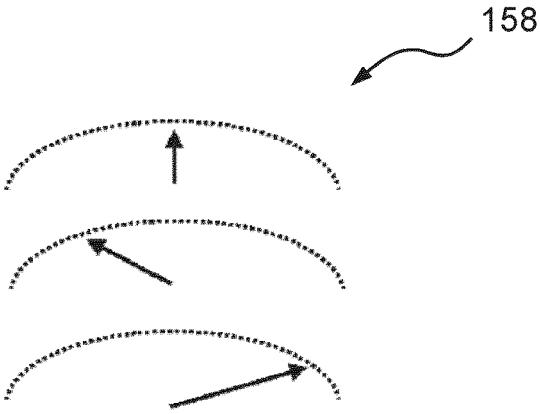
Figure 17E:
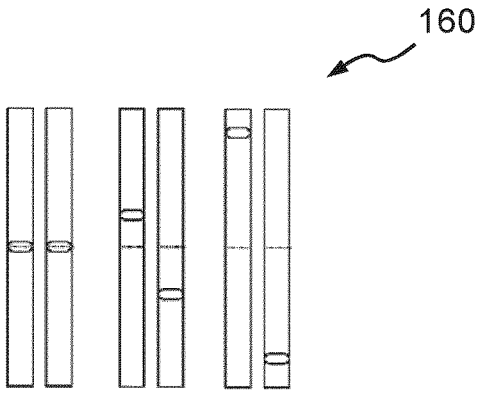

The embodiments 154, 156 of FIGS. 17*b* and 17*c* are similar to the embodiment of FIG. 17*a* in that they shows the difference between the two inputs via a dot sliding in a track. In the embodiment 158 of FIG. 17*d*, an arrow points to the direction in which the force is greatest. In the embodiment 160 of FIG. 17*e*, two different behaviours can be provided. In a first behaviour, the two dots are used to display the difference between the two readings. In another embodiment, the two dots show the actual force reading of the left and right input device. When no force is applied, both dots are centred in their vertical bar. When positive force is applied to the left input device, the dot in the left bar will move upwards. When positive force is applied to the right input device, the dot in the right bar will move upwards. If the user input is balanced, then the two dots will move in the same manner. If there is imbalance, one dot will move more than the other. The user can then try to keep both dots moving the same amount.

In all five embodiments, the user is graphically shown if there is an imbalance in their force input. However, in the last embodiment, the user is further shown the overall size of the force input.

It is to be noted that the figures and the above description have shown the example embodiments in a simple and schematic manner. Many of the specific mechanical details have not been shown since the person skilled in the art should be familiar with these details and they would just unnecessarily complicate this description. For example, the specific materials used and the specific manufacturing procedures used have not been described in detail since it is maintained that the person skilled in the art would be able to find suitable materials and suitable processes to manufacture the strength training machines according to the current invention.

The invention claimed is:

1. Motorized strength training machine comprising an electric motor unit, an axle and a first user force input element, said electric motor unit comprising an electric motor, said electric motor being connected to said axle such that rotation of the electric motor drives said axle and rotation of the axle drives the electric motor, and said first user force input element being connected to said axle such that rotation of said axle displaces the first user force input element and displacement of said first user force input element rotates the axle, said machine further comprising a mechanical range limiting mechanism comprising displaceable first and second rotation limiting stop elements which can be mechanically locked at different angular locations around the axle to mechanically limit the range of rotational motion of the axle, characterized in that the mechanical range limiting mechanism comprises a motorized displacement mechanism which is arranged to displace the first and/or second rotation limiting end stops angularly around the axle based on inputs from a controller.

2. Motorized strength training machine according to claim 1, characterized in that the displacement mechanism comprises an electric motor to drive the displacement mechanism, said electric motor being controlled by the controller.

3. Motorized strength training machine according to claim 1, characterized in that the displacement mechanism comprises a ring arranged rotationally around the axle, said ring being provided with an engagement mechanism to selectively engage one of the first or second range limiting end stops with the ring so that rotation of the ring displaces the first or second range limiting end stop engaged with the ring or disengage both range limiting end stops from the ring so that rotation of the ring does not displace the first or second range limiting end stops.

4. Motorized strength training machine according to claim 3, characterized in that the engagement mechanism comprises a displaceable sliding element on each rotation limiting end stop and a protrusion on each slideable element arranged in a slot on the ring, said slot having a main circular slot portion and an offset circular slot portion which is offset from the main circular slot portion and connected to the main circular slot with a ramped portion at either side.

5. Motorized strength training machine according to claim 1, characterized in that the mechanical range limiting mechanism comprises at least two indicator elements, one indicator element associated with each rotation limiting end stop to indicate to a user the position of the respective rotation limiting end stop.

6. Motorized strength training machine according to claim 1, characterized in that the mechanical range limiting mechanism comprises a circular array of light elements arranged around the axle, the light elements indicating the position of the first and second range limiting end stops by lighting up at least two of the light elements.

7. Motorized strength training machine according to claim 6, characterized in that the first and second range limiting end stops provide a light connection between a stationary light source arranged behind the first and second range limiting end stops and a light element of the circular array of light elements to selectively light up the light elements to which the first and second range limiting ends stops are connected.

8. Motorized strength training machine according to claim 1, characterized in that the motorized strength training machine further comprises a second user force input element, a first force sensor being mounted between the first user force input element and the motor and a second force sensor being mounted between the second user force input element and the motor, said second user force input element being connected to the axle such that rotation of the axle causes displacement of the second user force input element and displacement of the second user force input element causes rotation of the axle, said machine having a display with an indicator which indicates to the user the difference between the readings of the two force sensors.

9. System of motorized strength training machines comprising a first and second motorized strength training machines according to claim 1, said first and second motorized strength training machines each comprising a housing having a circular cross section taken on a vertical plane and being supported on a base portion, the electric motor unit arranged inside the housing, the first and second motorized strength training machines being arranged such that the axles of the first and second machines are arranged horizontally and are located at a first position relative to the base portion and a second position relative to the base portion respectively, characterized in that the housing and the electric motor unit are the same in the first and the second machine, but in that angular positions of the electric motor unit is different in the first and second machines so that the first and second positions of the axles relative to the base portion in the two machines are different.

10. Arrangement of motorized strength training machines comprising:

a first machine, the first machine comprising an electric motor unit, an axle and a first user force input element, said electric motor unit comprising an electric motor, said electric motor being connected to said axle such that rotation of the electric motor drives said axle and rotation of the axle drives the electric motor, and said first user force input element being connected to said axle such that rotation of said axle displaces the first user force input element and displacement of said first user force input element rotates the axle, said machine further comprising a mechanical range limiting mechanism comprising displaceable first and second rotation limiting stop elements which can be mechanically locked at different angular locations around the axle to mechanically limit the range of rotational motion of the axle, characterized in that the mechanical range limiting mechanism comprises a motorized displacement mechanism which is arranged to displace the first and/or second rotation limiting end stops angularly around the axle based on inputs from a controller and a second machine, the second machine comprising an electric motor unit, an axle and a first user force input element, said electric motor unit comprising an electric motor, said electric motor being connected to said axle such that rotation of the electric motor drives said axle and rotation of the axle drives the electric motor, and said first user force input element being connected to said axle such that rotation of said axle displaces the first user force input element and displacement of said first user force input element rotates the axle, said machine further comprising a mechanical range limiting mechanism comprising displaceable first and second rotation limiting stop elements which can be mechanically locked at different angular locations around the axle to mechanically limit the range of rotational motion of the axle, characterized in that the mechanical range limiting mechanism comprises a motorized displacement mechanism which is arranged to displace the first and/or second rotation limiting end stops angularly around the axle based on inputs from a controller, wherein the first machine and second machine provide different training types.

* * * * *